United States Patent [19]

Venkatesan

[11] Patent Number: 4,625,800

[45] Date of Patent: Dec. 2, 1986

[54] METHOD OF RECOVERING MEDIUM OR HIGH GRAVITY CRUDE OIL

[75] Inventor: V. N. Venkatesan, Arlington, Tex.

[73] Assignee: Mobil Oil Corporation, New York, N.Y.

[21] Appl. No.: 673,632

[22] Filed: Nov. 21, 1984

[51] Int. Cl.[4] ..... E21B 43/243

[52] U.S. Cl. ..... 166/256; 166/261; 166/272

[58] Field of Search ..... 166/256, 261, 272

[56] References Cited

U.S. PATENT DOCUMENTS 3,019,837 2/1962 Marx ..... 166/256

3,542,129 11/1970 Bauer ..... 166/261

3,978,925 9/1976 Redford ..... 166/261

4,024,915 5/1977 Allen ..... 166/261 X

*Primary Examiner*—George A. Suchfield

*Attorney, Agent, or Firm*—Alexander J. McKillop; Michael G. Gilman; Charles A. Malone

[57] ABSTRACT

An improved tertiary recovery method for obtaining medium and high gravity crude oil from subsurface formations is disclosed wherein the gravity of the crude oil is downgraded. An in-situ combustion method is used where the boiling temperature of a light viscous crude is altered to provide residual coke, enabling sustained combustion.

8 Claims, 2 Drawing Figures

METHOD OF RECOVERING MEDIUM OR HIGH GRAVITY CRUDE OIL

BACKGROUND OF THE INVENTION

A known method of enhanced oil recovery for low gravity crude oil is the In-Situ Combustion method. This method requires a minimum of two oil wells, one used as an injection well and the other used as a production well.

Oxygen, oxygen-enriched air or merely air is injected through the injection well to the low gravity crude oil bearing formation. Subsequent to the injection of an oxygen supply, the low gravity crude oil is ignited downhole by methods known in the art.

Ignition of the air/crude oil mixture can also be accomplished by injecting heated air or by introducing a chemical into the oil-bearing reservoir rock.

This method produces heat energy by burning some of the oil within the reservoir rock itself. The amount of oil burned and the amount of heat created during in-situ combustion can be controlled to some extent by varying the quantity of air injected into the reservoir. Although the physics and chemistry of in-situ combustion are extremely complex, the basic principles are logical. Basically, the combustion heat vaporizes the lighter fractions of the crude oil and drives them ahead of a slowly moving combustion front created as some of the heavier, unvaporized hydrocarbons are burned. Simultaneously, the heat vaporizes the water in the combustion zone. The resulting combination of gas, steam and hot water aided by the thinning of the oil due to heat and the distillation of light fractions driven off from oil in the heated region moves the oil from injection to production wells.

The attractiveness of in-situ combustion lies in the fact that it requires the injection of only compressed air. Although the in-situ combustion method is applicable to a wide variety of reservoirs, its limitation lies in medium and high gravity crude oil reservoirs.

Medium and high gravity crude oil reservoirs have a very low boiling point along with low viscosity. When an in-situ combustion process is started, distillation of light fractions driven off from the oil in the heated region moves rapidly from the injection well to the production well. Since medium and high gravity crude oil is composed largely of light fractions having a very low boiling point, the vapors move from the combustion zone so rapidly that very little coke, which sustains combustion, is left behind. As a result, the in-situ combustion method for enhanced oil recovery cannot be used in reservoirs that are comprised mainly of medium or high gravity crudes since combustion cannot be sustained and will extinguish itself after a very short period.

SUMMARY OF THE INVENTION

The present invention provides a tertiary enhanced oil recovery method for use on subsurface formations with an injection well and a production well having medium or high gravity crude oil. Oxygen is injected into the subsurface formation through the injection well and permitted to react with the low viscosity, high quality crude oil for a predetermined time. The chemical structure of the high quality crude oil is altered to raise its boiling temperature. Fluid containing oxygen is injected into the formation and the crude oil with a raised boiling temperature is ignited. The boiling temperature of the crude oil has been increased to a point where residual coke has been increased and in-situ combustion is sustained. Reduced quality crude oil is produced at the production well.

DESCRIPTION OF THE PREFERRED EMBODIMENT

Figure 1:
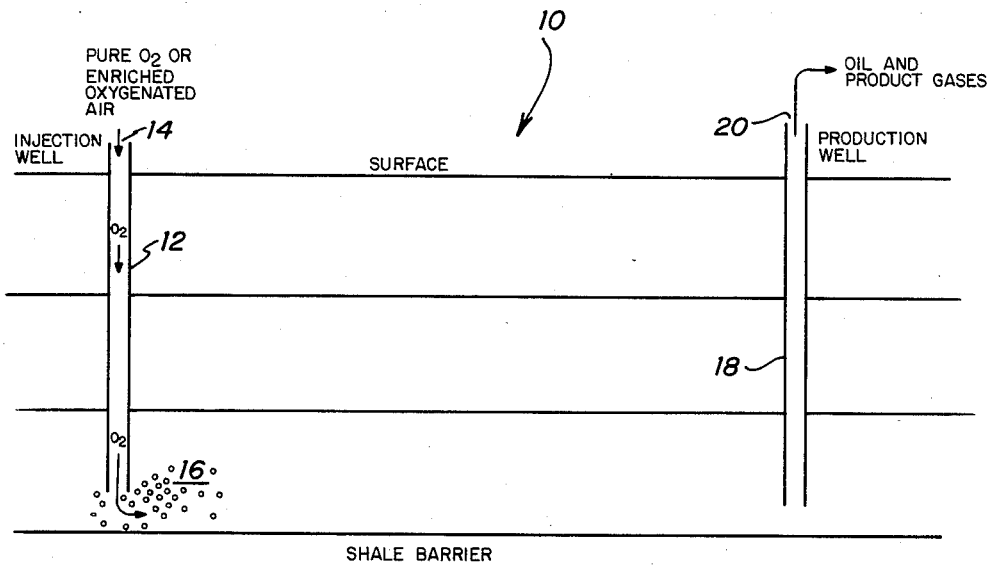
FIG. 1 is an illustration of an enhanced oil recovery system.

Referring to FIG. 1, a secondary or tertiary enhanced oil recovery system 10 is illustrated as having an injection well 12 having an injection area 14 at one end and connected to hydrocarbon reservoir 16 at the other. At a second location within reservoir 16, a production well 18 is illustrated as connecting hydrocarbon reservoir 16 to a production area 20. Contained within hydrocarbon reservoir 16 are medium and/or high gravity crude oil. Medium and high gravity crude oil has a very low viscosity and a very low boiling temperature and is often referred to as a light crude. Medium and high gravity crude oils, in general, are the most desirable since they are less viscous and readily flow through pipelines and, due to their low boiling temperature, require less heat energy to be processed in distillation towers which separate the fractions for use as various grades of fuels. A medium and high gravity crude oil will be composed primarily of lighter fractions, such as those used in gasoline and aviation fuels. As such, the medium and high gravity crude oils are more valuable than low gravity or very viscous crude oils.

Unfortunately, although the medium and high gravity crude oils are the most desirable, they provide problems for tertiary recovery methods once all the crude oil that can be obtained by secondary enhanced oil recovery methods has been produced.

A secondary enhanced oil recovery system used for low gravity or very viscous crude oil reservoirs is that of in-situ combustion. In this method, oxygen is injected downhole through injection well 12 and ignited to produce a burning front. Lighter fractions travel rapidly to the production well leaving the heavier fractions, sometimes referred to as "coke", to sustain combustion. Medium and high gravity crude oil does not contain many of the lower fractions found in low gravity crude oil. As such, the higher fractions move toward the production well leaving very little coke in its wake. So little coke is left when the higher fractions are driven towards the production well that in-situ combustion cannot be sustained and extinguishes due to the lack of adequate fuel. In order to overcome the problem of very few lower fractions and high quality, medium or high gravity, crude oil, oxygen is injected from injection area 14 through injection well 12 into hydrocarbon reservoir 16. The oxygen may be injected either as pure oxygen or oxygen-enriched air. Although varying percentages of oxygen in an oxygen-enriched fluid may be used, the preferred embodiment uses a minimum of 80 percent oxygen in an oxygen-enriched fluid. In the preferred embodiment, the oxygen-enriched fluid is permitted to react with the medium or high gravity crude oil in hydrocarbon reservoir 16 for a period of at least 24 hours. Although the normal reservoir temperature of hydrocarbon reservoir 16 is approximately 70°, oxidation will take place between the oxygen-enriched fluid and the medium or high gravity crude oil. This oxidation will take place at a very slow rate and will generate a certain amount of heat, although the heat generated will not raise the reservoir temperature above 500° F.

This oxidation will have two significant results. First, the quality of the crude oil will be reduced by increasing the viscosity of the crude oil and increasing its distillation behavior. Second, there will be a significant increase in the heavier fractions contained in the reservoir crude oil.

Figure 2:
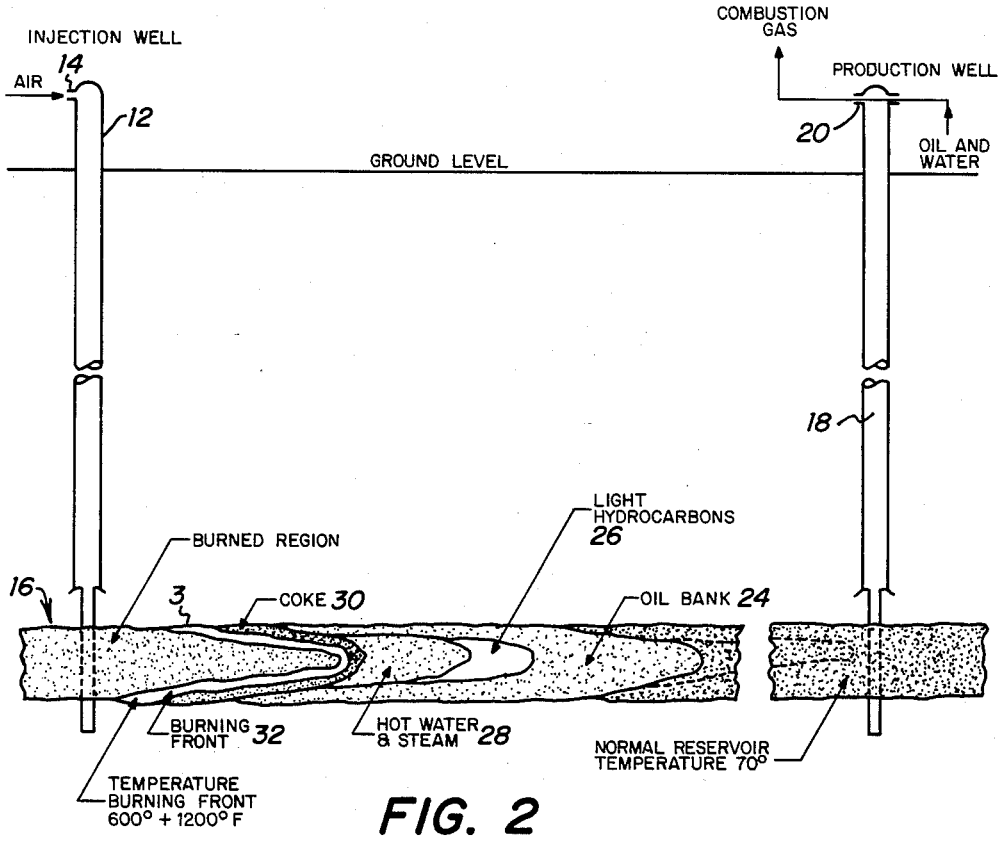
FIG. 2 is an illustration of an enhanced oil recovery system used for an in-situ combustion method.

Referring now to FIG. 2, the in-situ combustion process is illustrated after oxygen has been injected into reservoir 16 and has been allowed to react with the crude oil located therein. An oil bank 24 is illustrated as preceding a light hydrocarbons section 26 and a hot water and steam section 28 in the migration towards production well 18 from injection well 12. In the wake of oil bank 24, light hydrocarbon section 26 and hot water and steam section 28 is a residue of coke 30 which immediately precedes burning front 32. Coke 30 is comprised of the heavier fractions of the crude oil located in reservoir 16. Prior to the injection of oxygen and the reaction between the injected oxygen and the medium and high gravity crude oils, there would not have been enough coke 30 to sustain an in-situ combustion process. Due to the resultant lowering of the gravity of the medium and high gravity crude oil of reservoir 16 and raising of its boiling temperature, sufficient coke 30 or heavier fractions have been created to sustain combustion in an in-situ combustion enhanced oil recovery process.

It should be noted that the process of the present invention is most suitable as a tertiary enhanced oil recovery method. This is due to the fact that an actual degradation of the crude oil contained within the reservoir has been performed in order for the in-situ combustion method to take place. As such, economics dictates that as much of the higher quality medium and heavy gravity crude oil contained in the reservoir be removed prior to the use of the method of the present invention.

While the present invention has been illustrated by way of preferred embodiment, it is to be understood that it is not to be limited thereto, but only by the scope of the following claims.

I claim:

1. A method for recovering medium and high gravity crude oil from a subsurface hydrocarbon reservoir having at least two fluid communication paths to the surface comprising the steps of:

injecting oxygen-enriched fluid into the subsurface hydrocarbon reservoir, through a first fluid communication path;

permitting said oxygen-enriched fluid to react with the medium and high gravity crude oil in the subsurface hydrocarbon reservoir for about 24 hours, to form a lower grade crude oil;

injecting an oxygen-containing fluid into the subsurface hydrocarbon reservoir;

igniting said oxygen-containing fluid and a portion of said lower grade crude oil; and producing said lower grade crude oil at a second fluid communication path.

2. The method for recovering medium and high gravity crude oil according to claim 1 wherein said oxygen-enriched fluid is essentially pure oxygen.

3. The method for recovering medium and high gravity crude oil according to claim 1 wherein said oxygen-containing fluid is air.

4. A method to sustain an in-situ combustion process during the recovery of medium and high gravity crude oil from a subsurface reservoir containing said oil which reservoir has at least two communication paths to the surface comprising:

(a) injecting oxygen-enriched fluid into the subsurface hydrocarbon reservoir, through a first fluid communication path;

(b) permitting said oxygen-enriched fluid to react with the medium and high gravity crude oil in the subsurface hydrocarbon reservoir for a predetermined time, to form lower quality crude oil thereby creating coke or heavier fractions in said lower quality oil which is used to support combustion;

(c) injecting an oxygen-containing fluid into said reservoir; and (d) combusting said oxygen-containing fluid in said reservoir whereupon a portion of said coke or heavier fractions sustains the in-situ combustion process while producing the remainder of said lower quality crude oil to the surface.

5. The method as recited in claim 4 where in step (b) said oxygen-containing fluid is reacted with said medium or high gravity crude oil in the reservoir for at least 24 hours.

6. The method as recited in claim 4 where said oxygen-enriched fluid is oxygen-enriched air.

7. The method as recited in claim 4 where said oxygen-enriched fluid is essentially pure oxygen.

8. A method to sustain an in-situ combustion process during the recovery of medium and high gravity crude oil from a subsurface reservoir containing said oil which reservoir has at least two communication paths to the surface comprising:

(a) injecting oxygen-enriched fluid containing at least 80 percent oxygen into the subsurface hydrocarbon reservoir which reservoir is at temperature of about 70° F., through a first fluid communication path;

(b) permitting said oxygen-enriched fluid to react with the medium and high gravity crude oil in the subsurface hydrocarbon reservoir for at least 24 hours, to form lower quality crude oil thereby creating coke or heavier fractions in said lower quality oil which is used to support combustion;

(c) injecting an oxygen-containing fluid into said reservoir; and (d) combusting said oxygen-containing fluid in said reservoir whereupon a portion of said coke or heavier fractions sustains the in-situ combustion process while producing the remainder of said lower quality crude oil to the surface.

* * * * *